US011117031B1

(12) United States Patent
Bergstrom

(10) Patent No.: US 11,117,031 B1
(45) Date of Patent: Sep. 14, 2021

(54) GOLF PIN BALL TRAY

(71) Applicant: John A. Bergstrom, Dassel, MN (US)

(72) Inventor: John A. Bergstrom, Dassel, MN (US)

(73) Assignee: John A. Bergstrom, Dassel, MN (US)

( * ) Notice: Subject to any disclaimer, the term of this patent is extended or adjusted under 35 U.S.C. 154(b) by 0 days.

(21) Appl. No.: 17/142,976

(22) Filed: Jan. 6, 2021

Related U.S. Application Data

(63) Continuation-in-part of application No. 16/856,791, filed on Apr. 23, 2020, now abandoned.

(60) Provisional application No. 62/990,136, filed on Mar. 16, 2020, provisional application No. 62/955,750, filed on Dec. 31, 2019.

(51) Int. Cl.
*A63B 57/40* (2015.01)
*A63B 57/30* (2015.01)

(52) U.S. Cl.
CPC ..... *A63B 57/40* (2015.10); *A63B 57/357* (2015.10); *A63B 2225/093* (2013.01)

(58) Field of Classification Search
CPC .. A63B 57/40; A63B 57/357; A63B 2225/093
USPC ..... 473/175–179
See application file for complete search history.

(56) References Cited

U.S. PATENT DOCUMENTS

| | | | | | |
|---|---|---|---|---|---|
| 1,829,283 | A * | 10/1931 | Kip | A63B 57/40 473/177 |
| 2,031,525 | A | 5/1935 | Clarke | |
| 3,204,599 | A | 9/1965 | Milosch | |
| 3,572,707 | A | 3/1971 | Stapleton, Jr. | |
| 5,190,283 | A | 3/1993 | Hannon | |
| 6,478,687 | B1 | 11/2002 | Colonello | |
| 6,939,239 | B1 * | 9/2005 | Ash | A63B 57/357 473/176 |
| 7,431,658 | B2 | 10/2008 | Priegel | |
| 7,455,594 | B1 | 11/2008 | Priegel | |
| 10,471,316 | B1 * | 11/2019 | Bartlett | A63B 47/02 |
| 2004/0092325 | A1 | 5/2004 | Brown | |
| 2009/0098026 | A1 | 4/2009 | Wood | |
| 2009/0280919 | A1 | 11/2009 | Prince | |
| 2020/0330837 | A1 * | 10/2020 | Manley | A63B 57/357 |

* cited by examiner

*Primary Examiner* — Nini F Legesse
(74) *Attorney, Agent, or Firm* — Steven M. Koehler; Westman, Champlin & Koehler, P.A.

(57) ABSTRACT

A golf pin ball tray comprising a support surface having an inner aperture having a diameter of size to receive a shaft of a golf pin, the diameter being less than a diameter of a ferrule on an end of the shaft that is inserted in a golf cup, the support surface having a maximum diameter of about 55% to about 80% of an inner diameter of the golf cup.

20 Claims, 8 Drawing Sheets

GOLF PIN BALL TRAY

CROSS-REFERENCE TO RELATED APPLICATIONS

The present application is a continuation-in-part of patent application Ser. No. 16/856,791, filed Apr. 23, 2020, based on and claims the benefit of U.S. provisional patent application Ser. No. 62/955,750, filed Dec. 31, 2019 and U.S. provisional patent application Ser. No. 62/990,136, filed Mar. 16, 2020, the contents of which are hereby incorporated by reference in their entirety.

BACKGROUND

The discussion below is merely provided for general background information and is not intended to be used as an aid in determining the scope of the claimed subject matter.

The present invention relates to golf flag pins. More particularly, the present invention relates to a support tray mountable to the golf pin that supports one or more golf balls when the golf ball is in the cup.

In the game of golf, the golf flag pin is generally removed from the cup during putting when the golf balls are on the green. This was done because the rules applied a penalty if the ball struck the pin if the pin was left in the cup. However, recently, the rules of golf have been changed to allow the golf pin to remain in the cup during all putting on the green. Players are now not required to putt with the pin in the hole; rather, they now have the choice to have it removed or left in the cup. It is believed that this will speed up play since caddies are typically no longer accompanying players and as such are not tending the pins during putting. Instead one of the players would need to pull the pin and set it aside far enough away so as not to come into play during putting. Upon completion of the hole the pin would need to be retrieved from where it was set aside and replaced in the hole.

SUMMARY

A golf pin ball tray comprising a support surface having an inner aperture having a diameter of size to receive a shaft of a golf pin, the diameter being less than a diameter of a ferrule on an end of the shaft that is inserted in a golf cup, the support surface having a maximum diameter of about 55% to about 80% of an inner diameter of the golf cup.

A kit comprising a plurality of golf pin ball trays, each tray comprising a support surface having an inner aperture having a diameter of size to receive a shaft of a golf pin, the diameter being less than a diameter of a ferrule on an end of the shaft that is inserted in a golf cup, the support surface having a maximum diameter of the support surface of each tray is about 55% to about 80% of an inner diameter of the golf cup.

A golf pin ball tray comprising a support surface having an inner aperture having a diameter of size to receive a shaft of a golf pin, the diameter being less than a diameter of a ferrule on an end of the shaft that is inserted in a golf cup, the support surface including a rim at an outer perimeter edge, and wherein the rim includes at least one recess of size to receive a portion of a golf ball and inhibit movement of the golf ball on the rim.

DETAILED DESCRIPTION OF THE ILLUSTRATIVE EMBODIMENT

Figure 2:
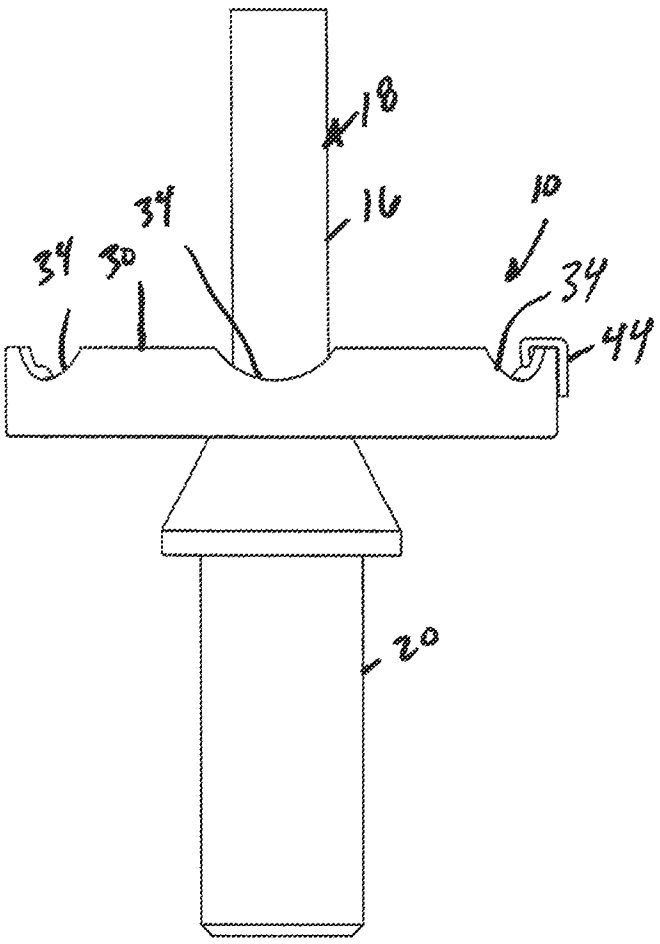
FIG. 2 is a side elevational view of the golf pin ball tray on the golf pin.
Figure 1:
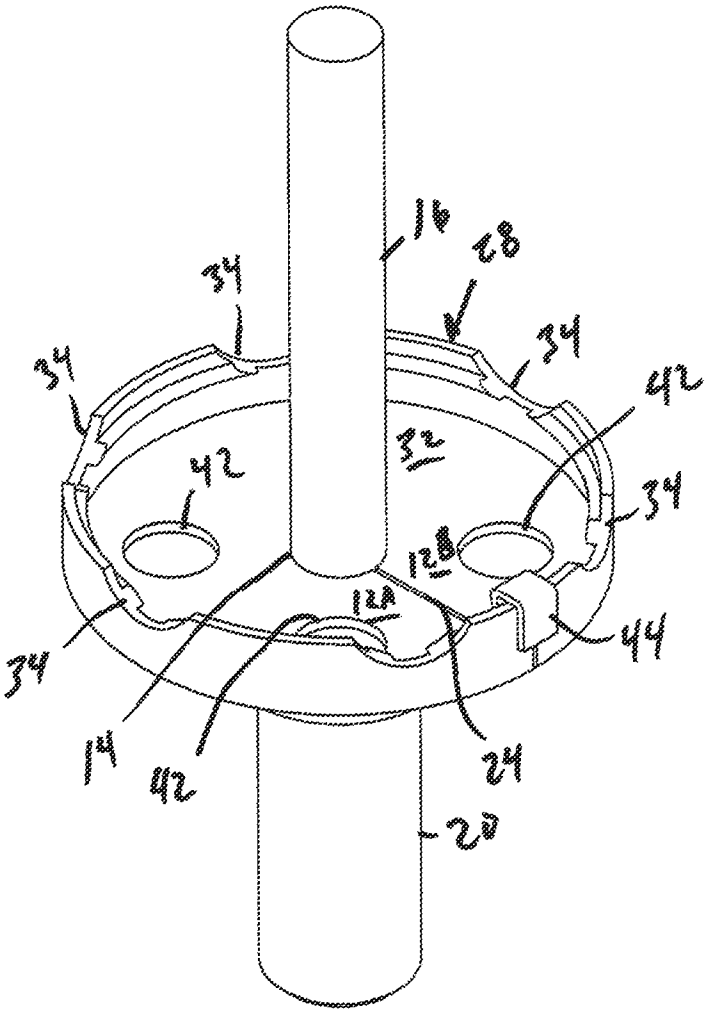
FIG. 1 is a perspective view of a golf pin ball tray on a golf pin.
Figure 3:
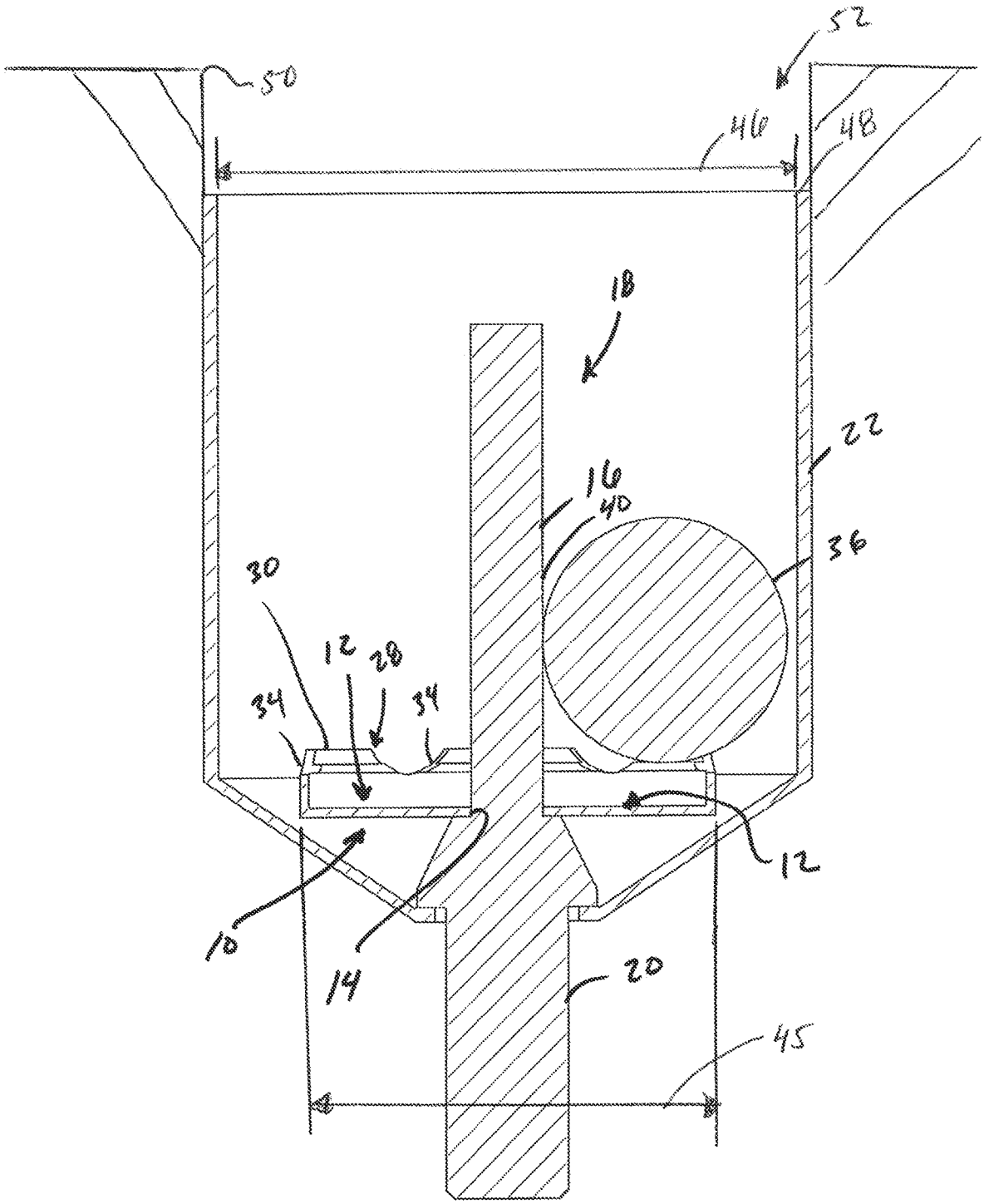
FIG. 3 is a sectional view of the golf pin ball tray, the golf pin and a golf ball in a cup.
Figure 4:
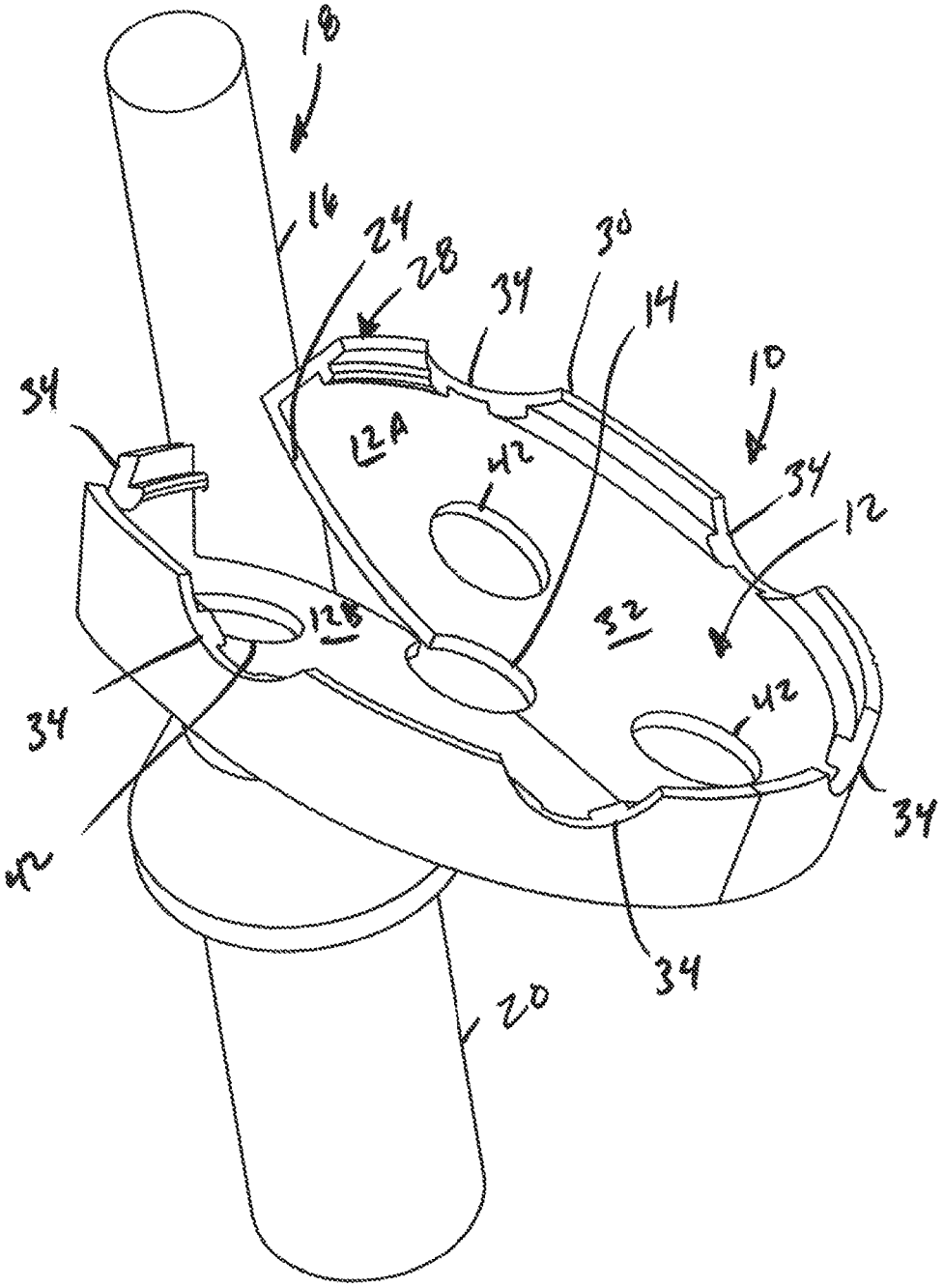
FIG. 4 is a perspective view of the golf pin ball tray being installed on the golf pin.

Referring to FIGS. 1-4, a golf pin ball tray 10 includes a support surface 12 having an inner aperture 14 having a diameter of size to receive a shaft 16 of a golf pin 18. The diameter is less than a diameter of a ferrule 20 on an end of the shaft 16 that is inserted into a golf cup 22. The support surface 12 includes at least one separation line 24 separating adjacent portions 12A, 12B of the support surface 12. The separation line 24 extends form the inner aperture 14 to an outer perimeter edge 28 of the support surface 12.

In a preferred embodiment, the perimeter edge 28 includes a rim 30 extending away from a major surface 32 of the support surface 12. Preferably the rim 30 extends in a direction that is perpendicular to the major surface 32 of the support surface 12. In yet a further embodiment, the rim 30 includes at least one recess 34 of size to receive a golf ball 36 that can hold the golf ball 36 temporarily in a stationary position as the golf pin 18 is removed from the golf cup 22 so as to retrieve the golf ball 36 without reaching down into the golf cup 22. If desired, a plurality of recesses 34 can be provided on the rim 30, each of the recesses being spaced apart from each other. In a preferred embodiment, at least three recesses 34 are provided on the rim 30.

The adjacent portions 12A, 12B of the support surface 12 are separable from each other so as to allow the golf pin ball tray 10 to be located about the shaft 16 of the golf pin 18. In one embodiment, the adjacent portions 12A, 12B are separable from each other in a direction that is non-planar to the major surface 32 of the support surface 12 prior to separation.

The support surface 12 can be flexible, and in one embodiment, twistable in opposite directions along the separation line 24. The separation line 24 can comprise a slit between the adjacent portions 12A, 12B although more than one separation line may be present if desired. In the tray 10, in one preferred embodiment, only one separation line 24 is present between the inner aperture 14 and the perimeter edge 28.

In a preferred embodiment, a radial distance between an edge of the inner aperture 14 and an edge of the rim 30 in contact with the golf ball 36 is greater than half a diameter of the golf ball 36. The rim 30 can extend away from the support surface 12, a distance that prevents the golf ball 36 from contacting the support surface 12 when the golf ball 36 is supported by the rim 30 and an outer surface 40 of the shaft 16. In other words, the location and height of the rim 30 can be selected so as to inhibit contact of the golf ball 36 with the support surface 12 such that the golf ball 36 leans against the outer surface 40. This helps maintain the golf ball 36 on the tray 10 even if the tray is tilted. Preferably, a maximum diameter 45 of the support surface 12 or tray 10 is about 50% to about 90% of an inner diameter 46 taken at an upper edge opening 48 of the golf cup 22. In a further embodiment, the maximum diameter 45 of the support surface 12 is about 55% to 80% of the inner diameter 46 of the golf cup 22. In yet a further embodiment, the maximum diameter 45 of the support surface is about 65% to 75% of the inner diameter 46 of the golf cup 22. The support surface and rim 30 can be circular but this is only one embodiment wherein other shapes can also be used, wherein the maximum diameter 45 may not be uniform about the shaft 16. The foregoing sizes of the tray 10 allow the tray 10 to be pulled out of the golf cup 22 and replaced without readily contacting the sidewalls or top edge of the golf cup 22.

The flat lower surface of the tray 10 spreads out the area of contact with the top edge 50 of the golf cup hole 52 in the soil so as to minimize damage in the event the tray 10 contacts the top edge 50 when the tray 10 is reinserted in the golf cup 22. Typically, the hole 52 in the soil is deeper than the axial length of the golf cup 22 such that the top edge 48 of the golf cup 22 is below the edge 50 of the hole 52 in the soil. By having a tray 10 with a support surface 12 having a maximum diameter 46 that is considerably less than that of the diameter of the hole 52 in the soil (herein as measured with respect to the inner diameter 46 of the golf cup 22), contact of the tray 50 with the edge 50 is reduced and damage to the edge 50 of the hole 52 is minimized. Hence a maximum diameter 45 of the tray 10 in the range of about 50% to about 75% of the inner diameter 46 of the golf cup 22 is particularly advantageous, while the maximum diameter 45 of the tray 10 being about 75% to about 80% of the inner diameter 46 of the golf cup 22 is also significantly advantageous, and the maximum diameter 45 of the tray 10 being about 80% to about 90% of the inner diameter 46 of the golf cup 22 is advantageous although contact with the edge 50 of the hole 52 in the soil is probably more likely.

The support surface 12 can include at least one drain hole 42 so as to allow water entering the golf cup to flow or drain passed the support surface 12.

In a preferred embodiment, the adjacent portions 12A, 12B of the support surface 12 are integral with each other being formed from a single unitary body. If desired, a fastener such as clip 44 can be used to retain the adjacent portions 12A, 12B together by spanning across the separation line 24. The fastener 44 can be used with integral or non-integral adjacent portions 12A, 12B, or in other words with all forms of adjacent portions 12A, 12B that are separable.

Figure 5:
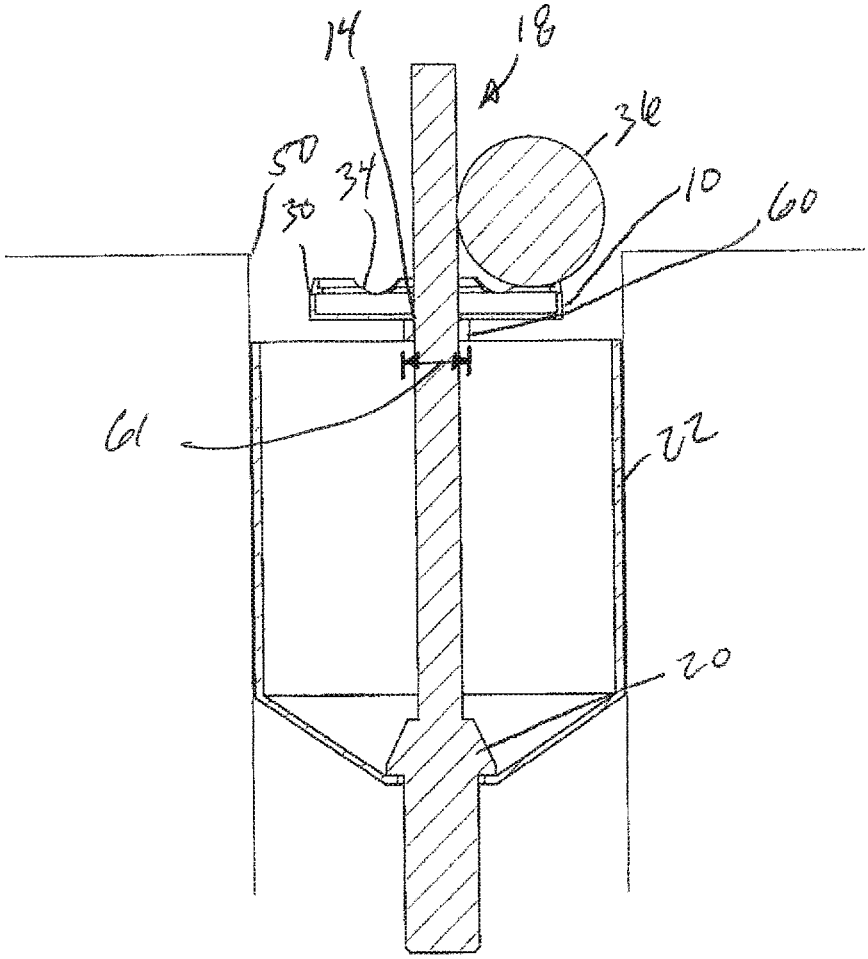
FIGS. 5-6 are sectional views of the golf pin ball tray, the golf pin and the golf ball in a cup.
Figure 6:
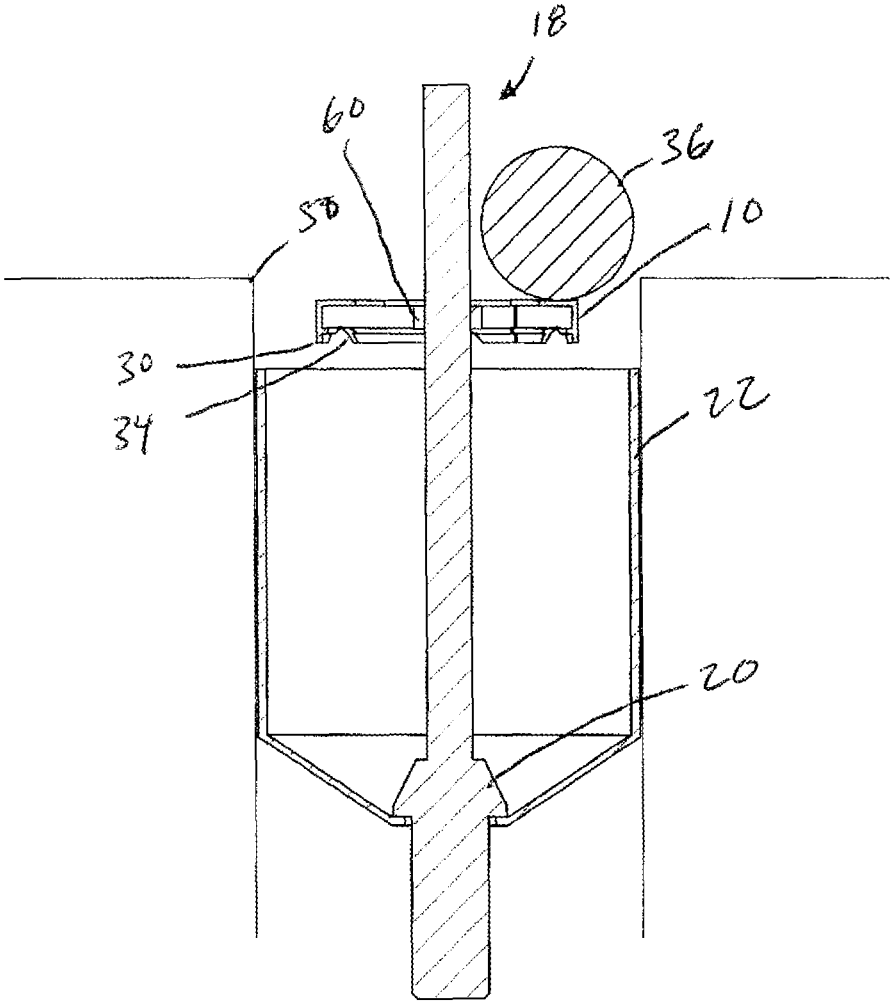

Referring to FIGS. 5 and 6, if desired, a stop 60 can be used to support the tray 10 at a desired location on the golf pin 18 above the ferrule 20. In one advantageous embodiment, the desired location of the tray 10 is below the lip 50 of the sod and above the ferrule 20 such that the golf ball 36 falls naturally into the cup 22 but is held at a position making the golf ball 36 easy to retrieve without lifting the pin 18 and tray 10 out of or partially out of the cup 22. Generally, the stop 60 is fixed on the golf pin 18 and has a width 61 so as to maintain the support tray 10 at the desired location on the golf pin 18. The stop 60 can take a number forms such as but not limited to a tape wound on the shaft of the golf pin 18, a cable or zip tie, a grommet, a split collar such as a split grommet having an integral fastener or a separate fastener to hold separable portions. The stop 60 can be affixed in a fixed, non-adjustable, position such as would be the case for example if tape is wound around the golf pin 18, or the stop 60 can be adjustably, fixed being slidable to a desired position once the stop 60 was affixed to the golf pin 18 such as could be the case with a cable or zip tie depending on how tight it is mounted to the golf pin 18. FIG. 5 illustrates that the tray 10 can be mounted such that the rim 30 supports the golf ball 36. In an alternative configuration illustrated in FIG. 6, the tray 10 is mounted such that the rim 30 is directed downwardly.

Although convenient, use of a stop 60 is optional for maintaining the tray 10 at the desired position on the pin 18 above the ferrule 20. If the tray 10 is configured such that sufficient friction is obtained when the tray 10 is located on the pin 18 such as if sufficient resiliency is present in the tray 10 to provide enough friction between the surfaces forming the aperture 14 of the tray 10 and the pin 18, and/or a fastener is provided to couple portions of the tray 10 together to maintain the sufficient friction between the surfaces forming the aperture 14 of the tray 10 and the pin 18, then the stop 60 may not be needed.

In a further embodiment, a plurality of trays 10 are provided as a kit so as to be installed on all the golf pins 18 on a golf course. The kit can include a sufficient number of stops 60 if desired.

It should be noted the tray 10 and/or stop 60 can be made of any suitable material that is rigid or at least somewhat flexible and resilient. Suitable materials include plastic, metals, rubber, etc.

The present invention also includes a method of providing a golf pin ball tray 10 on a golf pin 18. The method includes: providing a support tray 10 having a support surface 12 with an inner aperture 14 having a diameter of size to receive a shaft 16 of the golf pin 18, the diameter being less than a diameter of a ferrule 20 on an end of shaft 16 that is inserted in a golf cup 22, the support surface 12 having at least two adjacent portions 12A, 12B with a separation line 24 extending from the inner aperture 14 to an outer perimeter edge 28; and orienting the adjacent portion 12A, 12B so that major surfaces thereof are coplanar with each other.

In a preferred embodiment, orienting the portions 12A, 12B comprises twisting the portions 12A, 12B relative to each other. Twisting the portions 12A, 12B can include twisting the portions 12A, 12B in opposite directions.

The method can further include displacing the adjacent portions 12A, 12B away from each other to allow locating the tray 10 on the golf pin 18 and prior to orienting the adjacent portion 12A, 12B so that major surfaces thereof are coplanar with each other. Furthermore, the method can include after displacing the adjacent portions away from each other, inserting the shaft 16 between the displaced portions 12A, 12B. In one embodiment, inserting can comprise causing the shaft 16 to move from the outer perimeter edge 28 to the inner aperture 14. Displacing can also comprise twisting, for instance if the support surface 12 is flexible. A fastener 44 spanning across the separation line 24 can be used to join the adjacent portions 12A, 12B together after the portions 12A, 12B have been so that major surfaces thereof are coplanar with each other.

Figure 7:
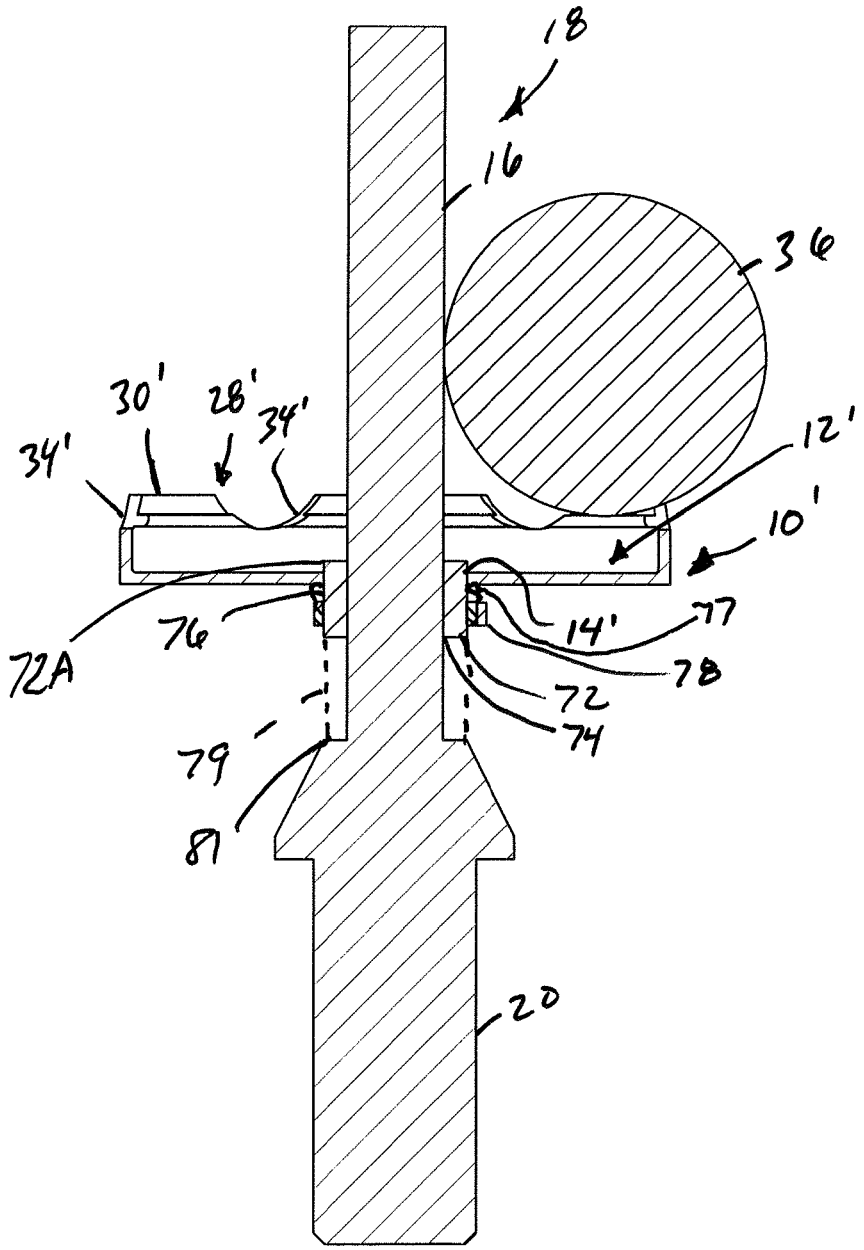
FIG. 7 is a sectional view of a second embodiment of a golf pin ball tray on a golf pin.
Figure 8:
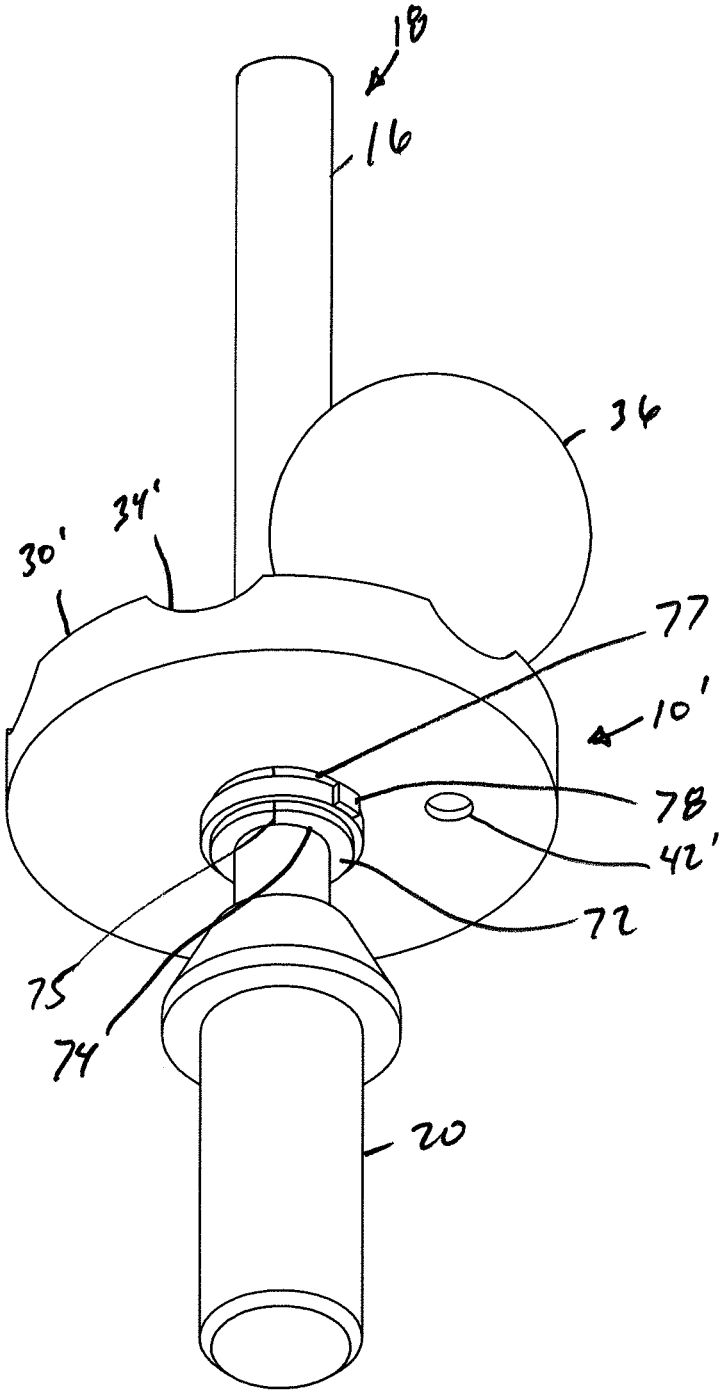
FIGS. 8-9 are perspective views of the golf pin ball tray of FIG. 7.
Figure 9:
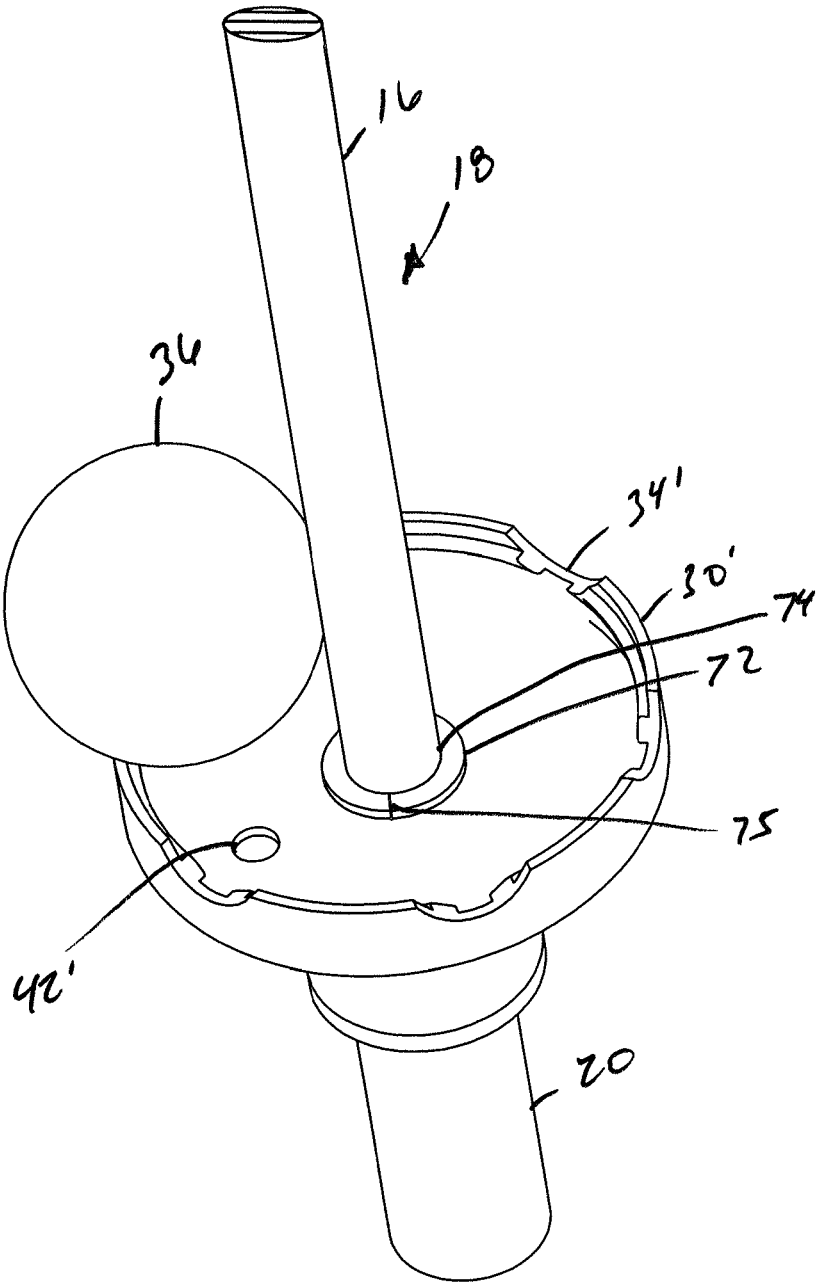

FIGS. 7-9 illustrate a second embodiment of a golf pin tray 10'. The same reference numbers (denoted with an apostrophe) are used in FIG. 7-9 to indicate same or similar features or elements as described above. Unlike the golf tray 10 above, the golf tray 10' does not have a radially extending separation line extending form an inner aperture 14' to an outer perimeter edge 28' of a support surface 12'. Rather the inner aperture 14' is preferably of a size that allows an upper end of the pin 18 to be inserted through the inner aperture 14'. However in order to hold the tray 10' level on the pin 18 in typically a fixed position, a stop 72 is provided that has an inner aperture 74 of size to receive an upper end of the golf pin 18 opposite the ferrule 20 and/or may include a complete slit or separation line 75 extending from the inner aperture 74 to an outer perimeter 76 of the slot, or a partial separation line that does not extend all the way to and through the outer perimeter 76. The stop 72 can include a groove, not shown, along the outer circumference of the outer perimeter 76 that an edge of the support surface 12' forming the inner aperture 14' can extend into. Typically, the diameter of an upper portion 72A the stop 72 and the diameter of the inner aperture 14' are selected so as to fit snugly.

A fastener 78 is preferably provided to reduce the inner aperture 74 and/or otherwise squeeze the stop 72 such that the stop 72 grips the golf pin thereby holding the stop 72 and tray 10' thereattached are held in a fixed position on the golf pin 18, although some sliding movement of the stop 72 on the golf pin 18 may be allowed so as to select a position of the stop 72 and tray 10' on the golf pin 18. Preferably, the fastener 78 encircles an outer perimeter of the stop 72 so as to attach the stop 72 to the golf pin 18. An elongated fastener can be used such as a wire, rope or the like. A particularly convenient elongated fastener is a zip tie. It should be noted a radial distance between an edge of the inner aperture 14' and an edge of the rim 30' in contact with the golf ball 36, and the relative size of the tray 10' and support surface 12' to the diameter of the golf ball 36 and/or the inner diameter of the cup 22 is the same as that described above with respect to tray 10. In yet a further embodiment, the stop can include a lower stem 79, a lower end 81 of which contacts the ferrule 20 and thus sets the height of the tray 10 or 10' within the cup 22. The stem 79 can also have a separation line like separation line 75. The stops 60 and 72 can comprise separate parts as illustrated or formed integral with the associated tray 10, 10' as a single unitary body. The stops 60 and 72 can comprise complimentary mating parts that snap together to secure the stops 60 and 72 with the associated tray 10, 10'. These complimentary parts can be proximate, for example, be the edge of the inner aperture 14, 14' of the tray 10, 10', or be spaced from the edge of the inner aperture 14, 14'.

It should be noted the stop 72 can take any number of forms. For example, the stop 72 can comprise but not limited to a grommet. As shown in FIG. 7, preferably, the stop 72 has an upper portion 72A that will fill the annular gap in the inner aperture 14' of the tray 10'. The stop 72 can also optionally include an annular flange 77 (which could also comprise a plurality of annular spaced apart projections) that engages a lower surface of the support surface 12'. Sufficiently filling the annular gap between the inner aperture 14' and the shaft 18' and/or providing annular flange 77 (which could also comprise a plurality of annular spaced apart projections) helps ensure that the tray 10' remains substantially horizontal so as to preferably retain the golf ball 36 against the shaft 18' rather than in contact with the inner surface of the cup. In this manner, the golf ball 36 does not rub against the soil of the top edge 50 of the hole 52, which could cause damage to the lip of the hole.

Although the subject matter has been described in language directed to specific environments, structural features and/or methodological acts, it is to be understood that the subject matter defined in the appended claims is not limited to the environments, specific features or acts described above as has been held by the courts. Rather, the environments, specific features and acts described above are disclosed as example forms of implementing the claims.

What is claimed is:

1. A golf pin ball tray comprising a support surface having an inner aperture having a diameter of size to receive a shaft of a golf pin, the diameter being less than a diameter of a ferrule on an end of the shaft that is inserted in a golf cup, the support surface having an edge with a maximum diameter of about 55% to about 80% of an inner diameter of the golf cup, the edge being configured such that a golf ball contacts the edge and leans against a golf pin, when the golf pin extends through the inner aperture.

2. The golf pin ball tray of claim 1, wherein the edge comprises a rim on the support surface having a location from the inner aperture and a height that inhibits contact of a golf ball with a major surface of the support surface between the inner aperture and the rim when the golf ball is on the tray such that the golf ball contacts the rim and leans against the golf pin, when the golf pin extends through the inner aperture.

3. The golf pin ball tray of claim 2, wherein the support surface and the rim are integral being formed from a single unitary body.

4. The golf pin ball tray of claim 2, wherein the rim extends in a direction that is perpendicular to the major surface of the support surface.

5. The golf pin ball tray of claim 2, wherein the rim includes at least one recess that is sized to receive a portion of the golf ball and inhibit movement of the golf ball on the rim.

6. The golf pin ball tray of claim 1 and further comprising a stop affixable to a golf pin and having a width greater than the diameter of the inner aperture to support the tray on the golf pin at a selected height.

7. The golf pin ball tray of claim 6 and further comprising a fastener secured to the stop.

8. The golf pin ball tray of claim 7, wherein the fastener is elongated and securable to an outer perimeter of the stop.

9. The golf pin ball tray of claim 8, wherein the fastener comprises a zip tie.

10. The golf pin ball tray of claim 9 wherein the stop is a separate element from the support surface.

11. The golf pin ball tray of claim 6, wherein the stop is a separate element from the support surface.

12. The golf pin ball tray of claim 1, wherein the maximum diameter of the support surface is about 65% to about 75 of the inner diameter of the golf cup.

13. The golf pin ball tray of claim 1, wherein the support surface includes at least one drain hole.

14. A kit comprising a plurality of golf pin ball trays, each tray comprising a support surface having an inner aperture having a diameter of size to receive a shaft of a golf pin, the diameter being less than a diameter of a ferrule on an end of the shaft that is inserted in a golf cup, the support surface having an edge with a maximum diameter on the support surface of each tray being about 55% to about 80% of an inner diameter of the golf cup, each edge being configured such that a golf ball contacts the edge and leans against a golf pin, when the golf pin extends through the inner aperture.

15. The kit of claim 14 and further comprising a plurality of stops, each stop being affixable to a golf pin and having a width greater than the diameter of the inner aperture to support the tray on the golf pin at a selected height, and a plurality of fasteners, each fastener being securable to a stop.

16. The kit of claim 15, wherein each fastener is elongated and securable to an outer perimeter of each associated stop.

17. The kit of claim 16, wherein each stop comprises a grommet having a grommet inner aperture and a separation line extending from the grommet inner aperture, and each fastener comprises a zip tie.

18. The kit of claim 17, wherein the maximum diameter of each support surface is about 65% to about 75% of the inner diameter of the golf cup.

19. The kit of claim 14 wherein each edge comprises a rim on the support surface having a location from the inner aperture and a height that inhibits contact of a golf ball with a major surface of the support surface between the inner aperture and the rim when the golf ball is on the tray such that the golf ball contacts the rim and leans against the golf pin, when the golf pin extends through the inner aperture.

20. The kit of claim 19, wherein the maximum diameter of the support surface is about 65% to about 75 of the inner diameter of the golf cup.

* * * * *